US005921155A

United States Patent [19]

Faller et al.

[11] Patent Number: 5,921,155

[45] Date of Patent: Jul. 13, 1999

[54] SHINGLE REMOVING APPARATUS

[76] Inventors: Craig A. Faller, 461 Carbon St., North Huntington, Pa. 15642; Michael A. Kalp, R.R. 1 Box 362, Hunker, Pa. 15632

[21] Appl. No.: 08/832,911

[22] Filed: Apr. 4, 1997

[51] Int. Cl.[6] ..... E04D 15/00

[52] U.S. Cl. ..... 81/45; 30/170; 299/36.1

[58] Field of Search ..... 81/45; 254/15, 254/21, 22, 25, 131.5; 30/169, 170; 299/36.1, 39

[56] References Cited

U.S. PATENT DOCUMENTS

| | | | |
|---|---|---|---|
| 3,628,833 | 12/1971 | Crispino | 30/170 |
| 4,699,430 | 10/1987 | Nichols | 30/170 |
| 4,880,491 | 11/1989 | Jacobs et al. | 81/45 |
| 5,001,946 | 3/1991 | Shirlin et al. | 81/45 |
| 5,197,784 | 3/1993 | Holder | 30/170 |
| 5,702,161 | 12/1997 | Finney et al. | 30/170 |
| 5,713,637 | 2/1998 | Worden et al. | 30/170 |
| 5,741,047 | 4/1998 | Ordonez | 81/45 |

*Primary Examiner*—David A. Scherbel
*Assistant Examiner*—Lee Wilson
*Attorney, Agent, or Firm*—F. Brice Faller

[57] ABSTRACT

A lever member is pivotable about a horizontal axis which is fixed to a frame defining a horizontal plane. A blade profiled to slide under a shingle is fixed to a front end of the lever member, and lifts the shingle when a rear end of the lever member pivots downward under action of a pneumatic cylinder. The cylinder is mounted horizontally toward the rear of the frame, oppositely from the front of the lever member. The cylinder pushes a transverse linkage member forward, which pulls on cables extending rearward from the linkage member thence upward around pulleys to the rear end of the lever member.

13 Claims, 3 Drawing Sheets

SHINGLE REMOVING APPARATUS

BACKGROUND OF THE INVENTION

The invention relates to a pneumatically powered apparatus for removing roofing material from a roof, in particular asphalt shingles, felt, and tar paper nailed to a pitched wooden deck.

Roofers generally use hand tools such as shovels and pry bars to remove roofing material. Specialized hand tools have been developed. See, for example, U.S. Pat. No. 5,280,676. However, any manual process is physically exhausting and time consuming, regardless of the tool used. As such, efforts have been made to develop an automated device, and some have been patented.

U.S. Pat. No. 4,269,450 discloses an apparatus having a rotary cutter head driven by an electric motor. As such it is heavy and requires a source of AC current.

U.S. Pat. No. 4,277,104 discloses a gasoline engine driven shingle remover with a flywheel and a system of links used to lift a plate which removes the shingles.

U.S. Pat. No. 4,709,479 discloses an apparatus which utilizes a vertically mounted pneumatic cylinder which pulls the rear end of a lever member downward in order to move a blade at the opposite end through an elliptical path of movement. Intermediate the two ends is a complex series of links, cranks, and ratchets which also cause the apparatus to move forward as the blade is lifted.

U.S. Pat. No. 4,763,547 discloses an apparatus wherein a lift plate is driven by a pneumatic cylinder directly; there is no intermediate lever member for obtaining mechanical advantage. The apparatus is simple but appears to require a manual assist.

U.S. Pat. No. 4,880,491 discloses an apparatus using an electric motor and a series of belts and links to lift a shingle removing plate. The apparatus is relatively cumbersome, and requires cables and a drive track to stabilize it on a roof. However, the patent offers a detailed discussion of the prior art and its disadvantages. Gasoline engines are considered unsuitable due to the fuel hazard, the noise, and the need to keep the carburetor floats level. Top heavy devices tend to topple over and fall off the roof.

SUMMARY OF THE INVENTION

The object of the present invention is to provide a relatively simple pneumatically operated shingle removing apparatus which has a low center of gravity, is light in weight, and can be readily adjusted and maintained in the field. Pneumatics are especially desirable because they do not present the inherent hazards of electrical wires or gasoline. The air compressor can be kept at ground level, with only a single hose connected to the apparatus on the roof. Pneumatic cylinders are quiet, reliable, and easy to replace.

The apparatus according to the invention includes a frame having a substantially horizontal platform with a rear portion on which a pneumatic cylinder is mounted so that the piston moves parallel relative to the platform. A lever member is pivotable about a horizontal axis toward the other end of the frame, the lever having a front end with a blade which is profiled to slide under the shingles, and a rear end which is pulled downward in order to lift the front end. On a pitched roof, the platform defines a working plane which is parallel to the plane of the roof, and the axis is parallel to the working plane.

The linkage between the pneumatic cylinder and the lever includes a transverse linkage member which is pushed forward by the pneumatic cylinder, a pair of cables which are pulled forward by the linkage member, and pulleys which guide the cables through ninety degrees or more to pull the rear end of the lever downward. The pulleys are journaled to an axle fixed in the frame, which axle is located below the rear end of the lever. Rear wheels are located outboard of the frame toward the rear portion of the platform. The relatively small front wheels are located in the forward portion of the frame platform, inboard of the side members which support the lifting blade.

The apparatus is designed so that most of the components, and therefore most of the weight, are kept very close to the platform and therefore very close to the roof. This minimizes the danger of the apparatus falling over, even on a steeply pitched roof.

The simplicity of the design also facilitates economic manufacture and ease of maintenance by a roofer.

DETAILED DESCRIPTION OF THE PREFERRED EMBODIMENT

Figure 1:
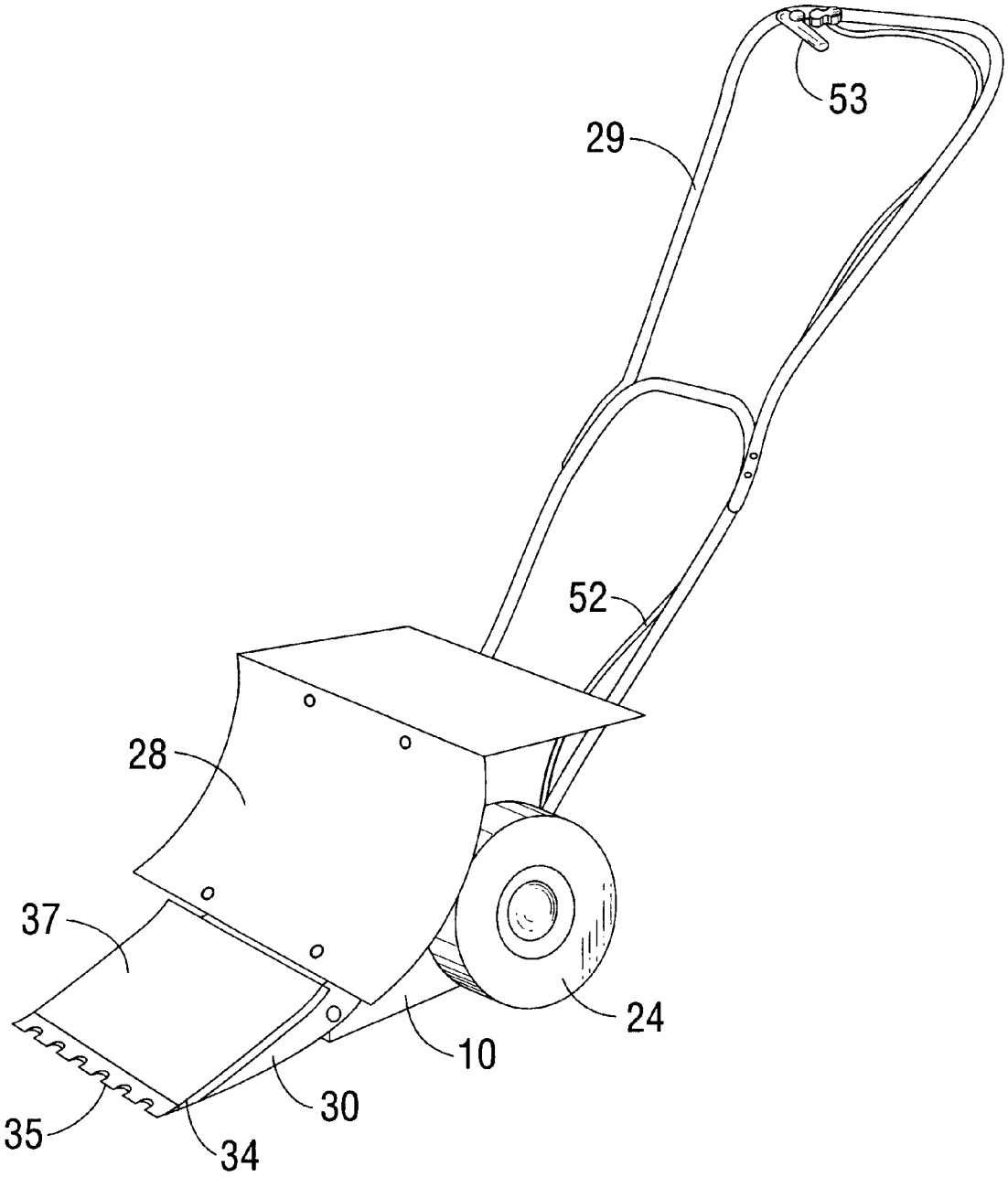
FIG. 1 is a perspective of the apparatus with cover in place.

Referring to FIG. 1, the apparatus includes a lever member 30 having a front end 34 with a blade 35 and a lifting plate 37 which is slid underneath shingles and lifted by means of linkage internal to cover 28 as will be described. The lifting movement is effected by means of a manually operated pneumatic valve 53 on handle 29. The valve is installed in pneumatic line 52 connected to a pneumatic cylinder mounted at the rear of frame 10.

Figure 2:
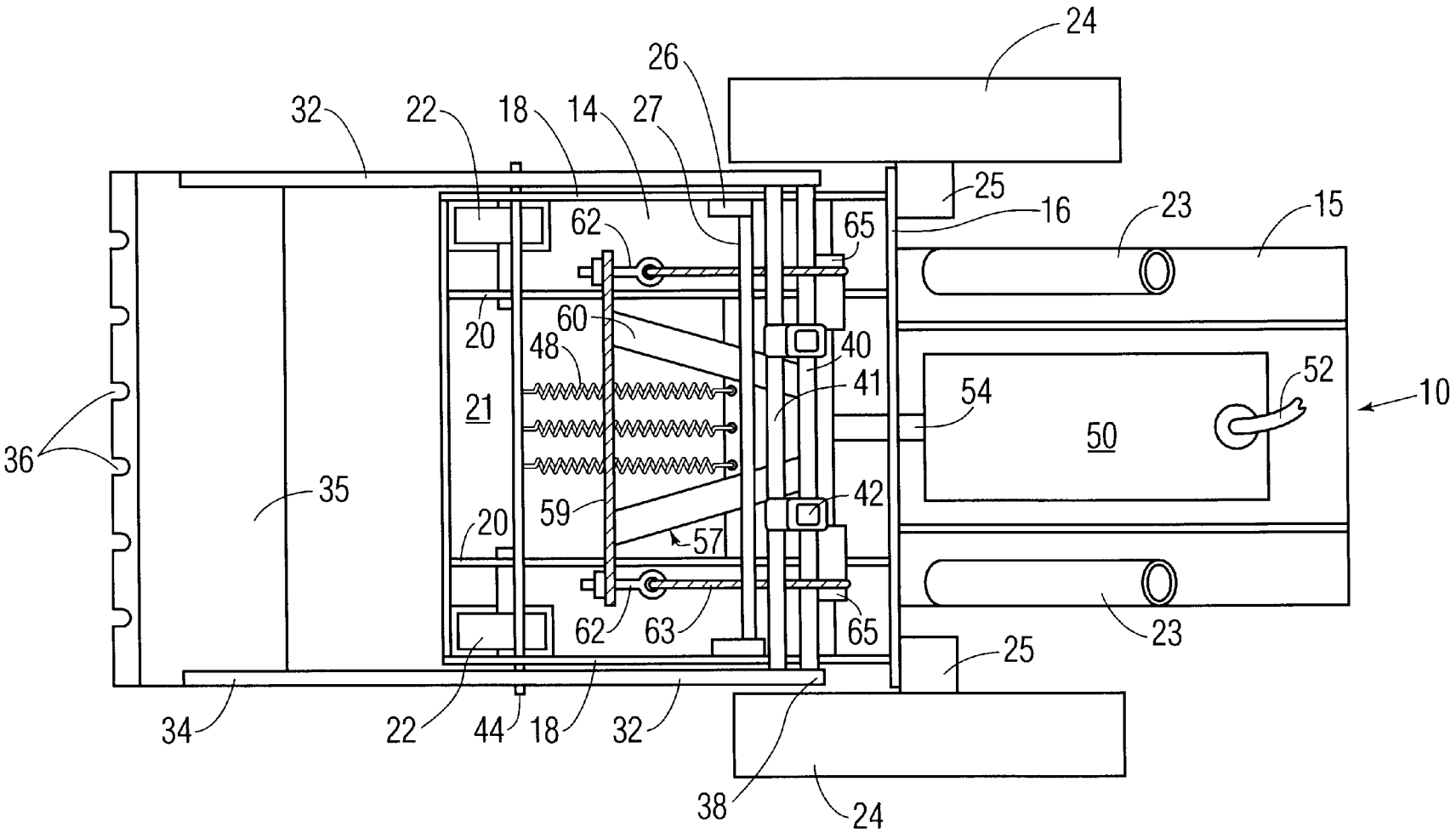
FIG. 2 is a plan view of the apparatus without the cover.

Referring to FIG. 2, the frame 10 includes a front portion 14, a rear portion 15, and a transverse wall 16 therebetween. Side members 18 extend along the outside of front portion 14 parallel to inside walls 20 on either side of a gap 21. A pair of front wheels 22 are journaled between inside walls 20 and respective side members 18. Rear wheels 24 are journaled on shoulder bolts which are threaded into blocks 25 welded to the transverse wall 16. A top bar 27 fixed between uprights 26 is used to fix the cover 28 (FIG. 1), while handle 29 is received in pipes 23 welded to the rear portion 15 of the frame.

The lever member 30 includes a pair of side members 32 extending from a front end 34 to a rear end 38, the lever member being pivotable about an axis defined by a pivot axle 44 fixed between the side members 32 and journaled in the side members 18 of the frame. A spring attachment member in the form of a plate 46 is welded to the pivot axle 44 and extends downward therefrom. Tension springs 48 are fixed to the plate 46 at one end and to the rear platform 12 of the frame 10 at the other end. The springs 48 urge the front end 34 downward against the lifting force of the pneumatic cylinder 50, as will be described.

The front end 34 includes a blade 35 welded to the side members 32. The blade 35 has an edge which is sufficiently sharp to facilitate sliding under shingles; the edge is provided with notches 36 which receive nails holding down the shingles. This assures that the nails are lifted with the shingles. The cover plate 37 (FIG. 1), which is welded to the side members 32 behind the blade, has been omitted from this view for clarity.

The rear end 38 includes a rear cross bar 40 and a parallel reinforcing bar 41 welded to the side members 32. Stanchions 42 fixed between the bars 40, 41 transmit force from the cross bar 40 to the reinforcing bar 41 when the rear end 38 is pulled downward, as will be described.

Figure 3:
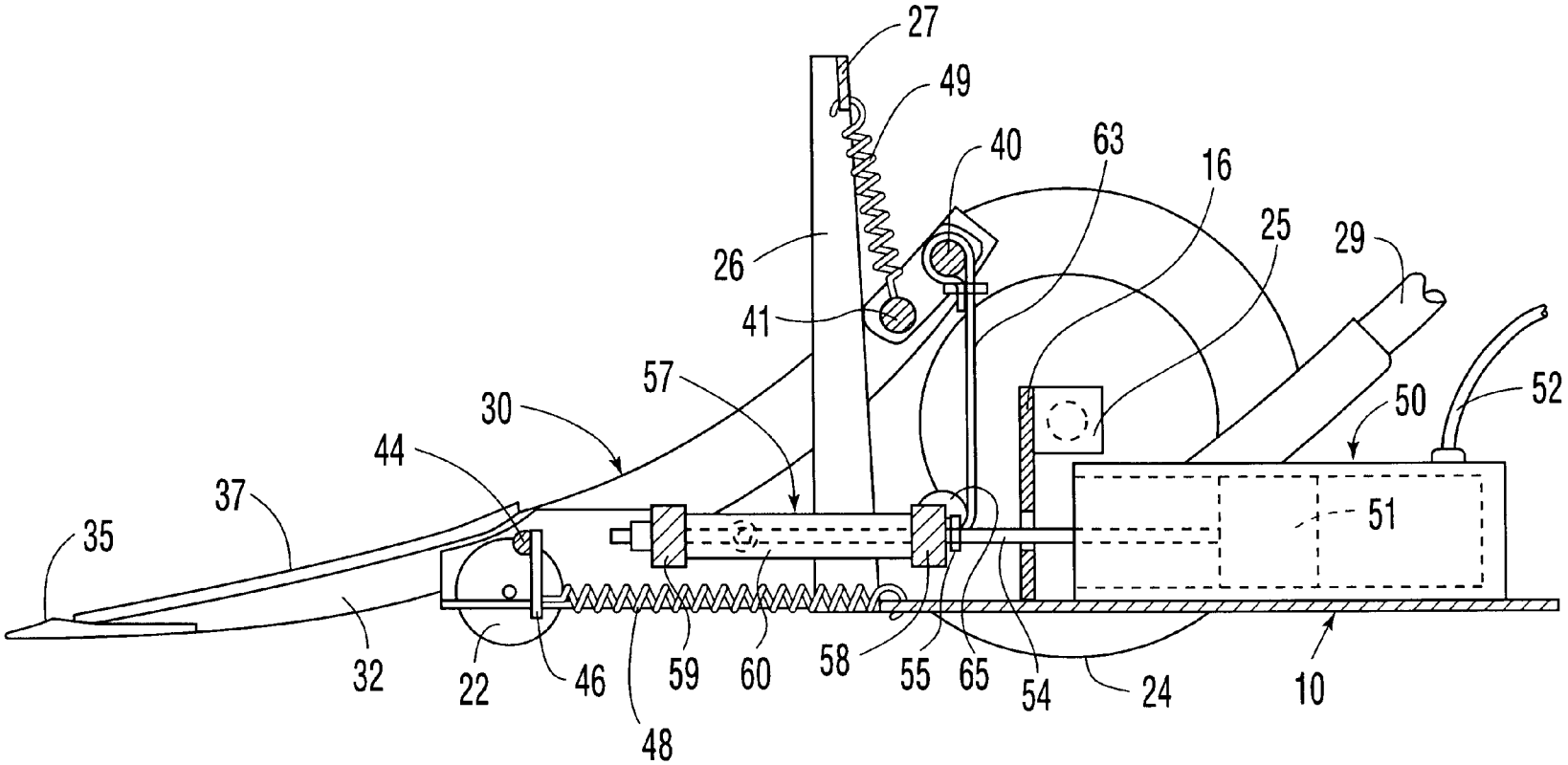
FIG. 3 is a side section view taken along line 3—3 of FIG. 2.

Referring also to FIG. 3, the linkage between the pneumatic cylinder 50 and the cross bar 40 begins with a shaft 54 extending from the pneumatic cylinder and fixed to a piston 51 inside the cylinder. When the piston is driven forward by high pressure air, the shaft 54 pushes a transverse linkage member 57 forward. The position of the shaft 54 relative to the linkage member 57 is adjusted by means of nuts 55 threaded on the shaft 54. These nuts bear against a rear bar 58, which transmits force to the front bar 59 by means of diverging spacer arms 60. The two bars 58, 59 and the arms 60 are welded together to form the transverse linkage member 57.

The front bar 59 extends outside of the spacer arms 60 on either side thereof in order to provide mounting points for a pair of eye bolts 62. These eye bolts provide adjustable fixing points for a pair cables of 63, which extend rearward around a respective pair of pulleys 65, and upward to the rear cross bar 40 where they are fixed by clamps. The symmetry of the cables with respect to the transverse linkage member 57 and the shaft 54 assures that the force transmitted by the shaft will pull the rear end 38 of the lever member downward uniformly between the side members 32. The symmetry of the tension springs 48 under the linkage member 57 provides a similar balance in the return force. Springs 49 fixed between top bar 27 and reinforcing bar 41 provide additional return force for lever member 30.

While a simple one way pneumatic cylinder has been depicted, it is also possible to use a two way cylinder which may be triggered to automatically return when the blade has been fully lifted or a limiting pressure is reached.

We claim:

1. Apparatus for removing shingles nailed to a roof defining a plane, said apparatus comprising a frame defining a working plane which is parallel to the plane of the roof, a lever member pivotable about an axis which is fixed relative to said frame, said axis being parallel to the working plane, said lever member having a front end on one side of said axis and a rear end on another side of said axis opposite from said one side, said front end having a blade profiled to slide under a shingle nailed to a roof until said blade is proximate to said nails, a pneumatic cylinder mounted to said frame, said pneumatic cylinder having a piston which is movable parallel to the working plane, and linkage between said piston and said rear end of said lever member, said linkage being effective to convert movement of said piston to downward movement of said rear end, thereby lifting said front end upward to remove said nails from said roof.

2. Apparatus as in claim 1 wherein said linkage comprises cable means and pulley means around which said cable means is routed.

3. Apparatus as in claim 2 wherein said linkage further comprises a shaft fixed to said piston and a transverse linkage member to which said shaft is fixed centrally, said cable means comprising a pair of cables, one said cable fixed to said transverse member on either side of said shaft, said pulley means comprising a pair of pulleys around which respective said cables are routed.

4. Apparatus as in claim 3 wherein said lever member comprises a rear cross bar at said rear end of said lever member above said pulleys, said cables being fixed to said rear cross bar.

5. Apparatus as in claim 3 further comprising a pulley axle mounted in said frame parallel to said axis, said pulleys being mounted on said pulley axle.

6. Apparatus as in claim 1 further comprising spring means which urges said front end downward.

7. Apparatus as in claim 6 wherein said lever member comprises a spring attachment member between said rear end and said front end, said spring means extending between said frame and said spring attachment member.

8. Apparatus as in claim 7 wherein said lever member comprises a pivot axle defining said axis, said spring attachment member being fixed to said pivot axle and extending downward from said pivot axle.

9. Apparatus as in claim 1 wherein said frame comprises a pair of side members and said lever member comprises a pair of side members extending from said front end to said rear end outside of said side members of said frame, said lever member further comprising a pivot axle fixed between said side members of said lever member, said pivot axle extending through said side members of said frame and defining said axis about which said lever member pivots.

10. Apparatus as in claim 8 wherein said apparatus further comprises front wheels journaled inboard of said side members of said frame.

11. Apparatus as in claim 10 wherein said front wheels are below said pivot axle.

12. Apparatus as in claim 8 wherein said apparatus further comprises rear wheels journaled outboard of said side members of said frame, said rear wheels being spaced to accommodate downward movement of said rear end of said lever member therebetween.

13. Apparatus as in claim 1 wherein said blade is provided with notches profiled to receive said nails.

* * * * *